US008573795B1

(12) United States Patent
Lai

(10) Patent No.: US 8,573,795 B1
(45) Date of Patent: Nov. 5, 2013

(54) WARNING LAMP AND WALKING STICK HAVING THE SAME

(75) Inventor: Yin-Wu Lai, Taichung (TW)

(73) Assignee: Chih-Yeh Chen (TW)

( * ) Notice: Subject to any disclaimer, the term of this patent is extended or adjusted under 35 U.S.C. 154(b) by 0 days.

(21) Appl. No.: 13/540,837

(22) Filed: Jul. 3, 2012

(51) Int. Cl.
*A45B 3/02* (2006.01)
*F21L 4/00* (2006.01)

(52) U.S. Cl.
USPC ..... 362/102; 362/109; 362/196

(58) Field of Classification Search
USPC ..... 362/196, 102, 109; 135/910
See application file for complete search history.

(56) References Cited

U.S. PATENT DOCUMENTS 5,219,402 A * 6/1993 Kondo et al. ..... 135/66
5,288,735 A * 2/1994 Trager et al. ..... 514/363
5,351,704 A * 10/1994 Hunnicutt et al. ..... 135/66
6,796,675 B2 * 9/2004 Galli ..... 362/200
7,604,366 B1 * 10/2009 Chen ..... 362/99
8,424,548 B2 * 4/2013 Willey ..... 135/66
2007/0151587 A1 * 7/2007 Yu ..... 135/66

* cited by examiner

*Primary Examiner* — Peggy A. Neils
(74) *Attorney, Agent, or Firm* — William E. Pelton; Cooper & Dunham LLP

(57) ABSTRACT

A warning lamp has a first assembling member, a second assembling member, a clamping space, an illuminating unit and a battery unit. The first assembling member is pervious to light and has a concave clamping section. The second assembling member is detachably and securely connected with the first assembling member and has a concave pressing section. The clamping space is formed between the pressing section and the clamping section and is capable of receiving a bar. The illuminating unit and the battery unit are securely mounted in the first assembling member. Because the second assembling member is detachably and securely connected with the first assembling member, the warning lamp can clamp different objects at different positions of the objects.

9 Claims, 11 Drawing Sheets

WARNING LAMP AND WALKING STICK HAVING THE SAME

BACKGROUND OF THE INVENTION

1. Field of the Invention

The present invention relates to a warning lamp and a walking stick having the same, and more particularly to a warning lamp and a walking stick having an illuminating function and a detachable structure.

2. Description of Related Art

With reference to FIG. 11, a conventional warning lamp 70 is mounted on a bottom of a walking stick 80 and has a main body 71, a lampshade 72 and an illuminating unit. The lampshade 72 is pervious to light and is mounted around the main body 71. The illuminating unit is mounted in the lampshade 72. When the illuminating unit lights up, light emitted from the illuminating unit penetrates the lampshade 72. Accordingly, the warning lamp 70 can have an illuminating function. With the warning lamp 70, a user can see the ground in a dark environment and can be seen by other vehicles for safety.

However, the warning lamp 70 can only be mounted on a walking stick 80 and cannot be mounted on other objects, such as an umbrella or a measuring wheel. Accordingly, the warning lamp is not versatile in use. Moreover, the warning lamp 70 cannot be mounted on different positions of the walking stick 80, and this is also inconvenient.

In addition, another conventional warning lamp can be mounted inside a walking stick or an umbrella, but the structure of the conventional warning lamp is complicated and cannot be mounted on other objects either.

To overcome the shortcomings, the present invention tends to provide a warning lamp to mitigate the aforementioned problems.

SUMMARY OF THE INVENTION

The main objective of the invention is to provide a warning lamp and a walking stick having an illuminating function and a detachable structure.

A warning lamp has a first assembling member, a second assembling member, a clamping space, an illuminating unit and a battery unit. The first assembling member is pervious to light and has a concave clamping section. The second assembling member is detachably and securely connected with the first assembling member and has a concave pressing section. The clamping space is formed between the pressing section and the clamping section and is capable of receiving a bar. The illuminating unit and the battery unit are securely mounted in the first assembling member. Because the second assembling member is detachably and securely connected with the first assembling member, the warning lamp can clamp different objects at different positions of the objects.

Other objects, advantages and novel features of the invention will become more apparent from the following detailed description when taken in conjunction with the accompanying drawings.

DETAILED DESCRIPTION OF PREFERRED EMBODIMENT

Figure 1:
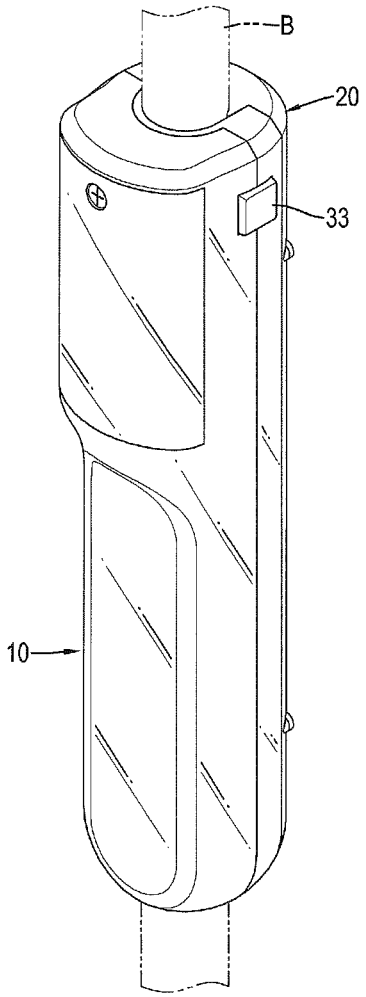
FIG. 1 is a perspective view of a warning lamp in accordance with the present invention.

With reference to FIGS. 1 to 4, a warning lamp in accordance with the present invention comprises a first assembling member 10, a second assembling member 20, a clamping space S, an illuminating unit 30 and a battery unit 40.

The first assembling member 10 is elongated, is hollow, is pervious to light and has an outer shell 11 and an inner shell 12. The outer shell 11 and the inner shell 12 are securely connected with each other by screws 13. The inner shell 12 has a side and a concave clamping section 121. The clamping section 121 is formed on the side of the inner shell 12 and is opposite to the outer shell 11. Preferably, the clamping section 121 is an elongated channel longitudinally formed in the side of the inner shell 12.

Figure 3:
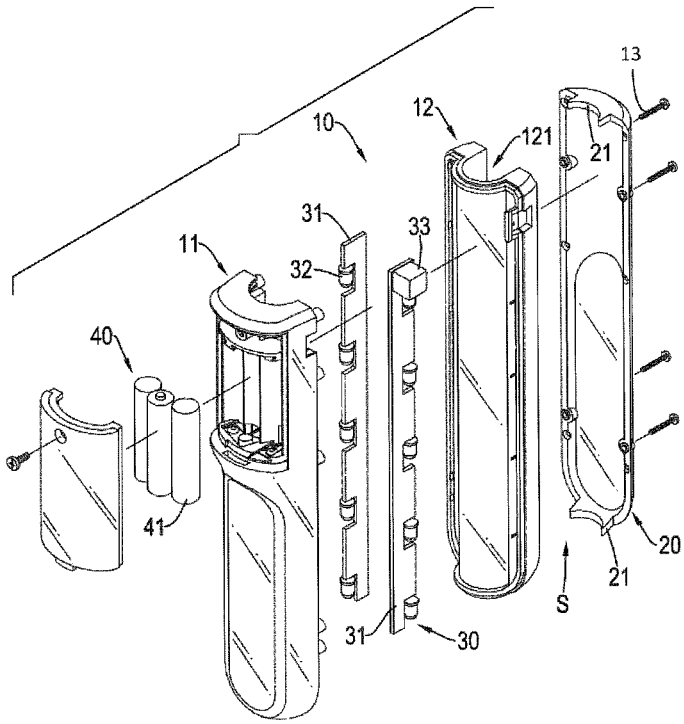
FIG. 3 is an exploded perspective view of the warning lamp in FIG. 1.
Figure 4:
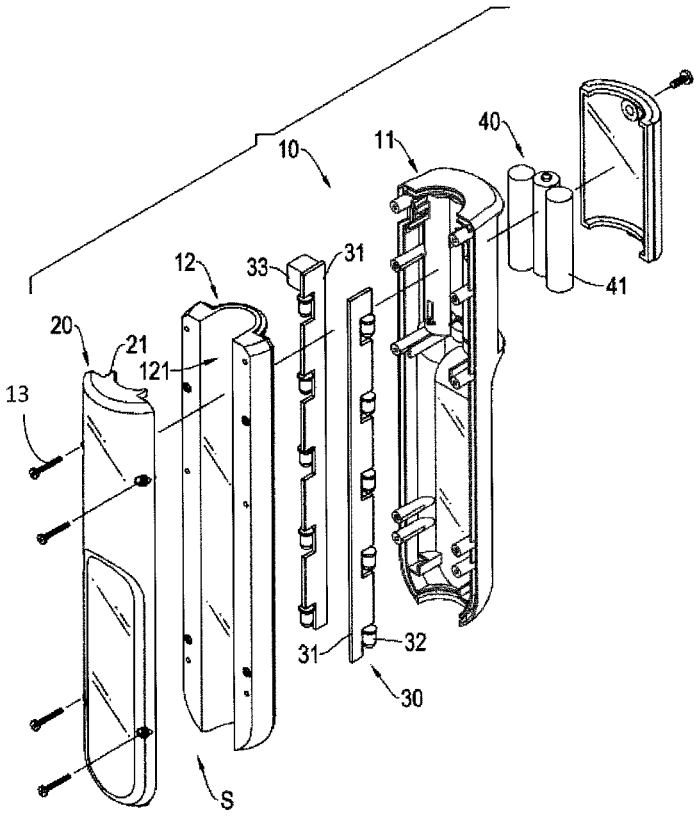
FIG. 4 is another exploded perspective view of the warning lamp in FIG. 1.
Figure 5:
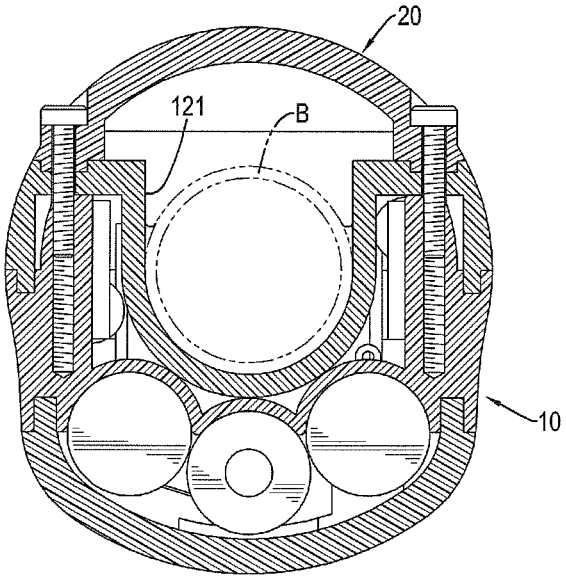
FIG. 5 is an enlarged top view in partial section of the warning lamp in FIG. 1.
Figure 6:
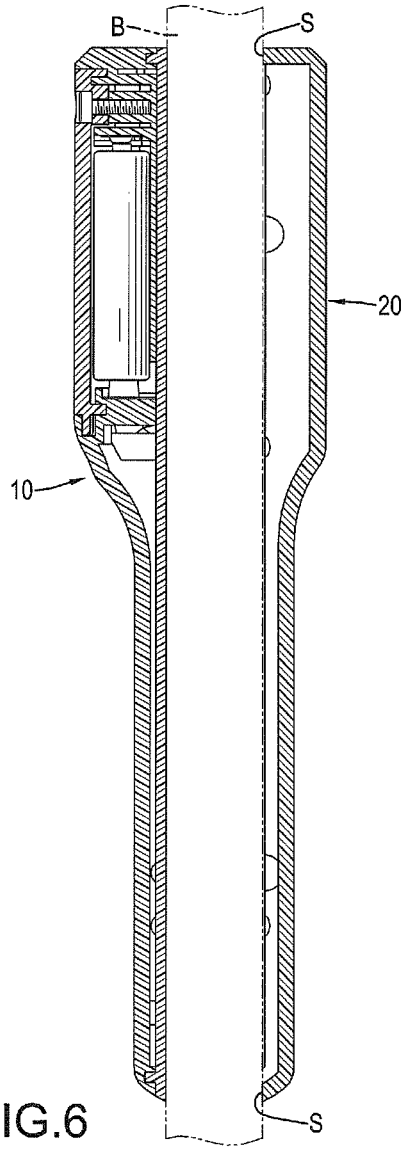
FIG. 6 is a side view in partial section of the warning lamp in FIG. 1.

With reference to FIGS. 3 to 5, the second assembling member 20 is detachably and securely connected with the first assembling member 10 and has a concave pressing section 21 facing the clamping section 121. Preferably, the pressing section 21 is two concave tabs. The tabs protrude from a side of the second assembling member 20 and are respectively inserted into a top and a bottom of the channel.

Figure 2:
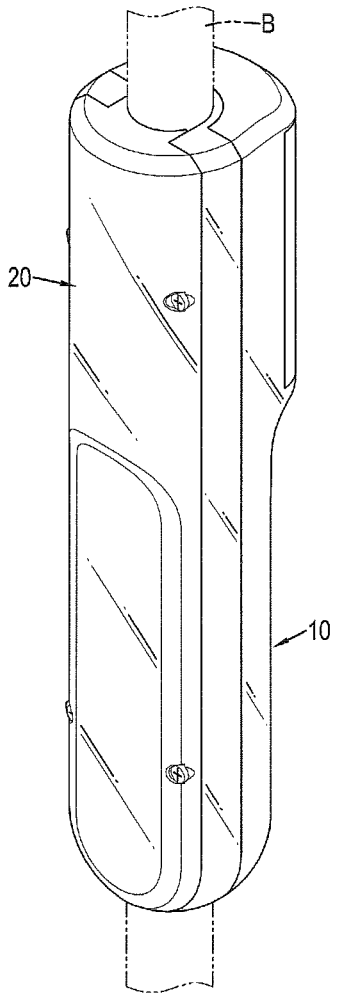
FIG. 2 is another perspective view of the warning lamp in FIG. 1.

The clamping space S is formed between the pressing section 21 and the clamping section 121 and is axially formed through the assembling members 10, 20 to receive a bar B as shown in FIGS. 1 and 2. Preferably, the clamping space S has two round areas. One of the areas is formed between the tab inserted into the top of the channel and the channel. The other of the areas is formed between the tab inserted into the bottom of the channel and the channel.

With reference to FIGS. 3 and 4, the illuminating unit 30 is securely mounted in the first assembling member 10, is located between the outer shell 11 and the inner shell 12 and has two circuit boards 31, multiple LEDs (light emitting diode) 32 and a switch 33. The circuit boards 31 are elongated and are respectively located at two opposite sides of an inner space of the first assembling member 10. The LEDs 32 are respectively mounted on the circuit boards 31. The switch 33 is mounted on one of the circuit boards 31 and is mounted through and protrudes out from a side of the first assembling member 10.

Figure 9:
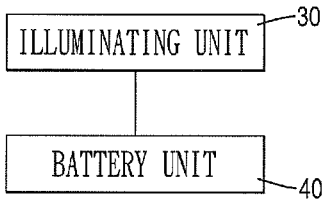
FIG. 9 is a block diagram of the illuminating unit and the battery unit of the warning lamp in FIG. 1.

With further reference to FIG. 9, the battery unit 40 is securely mounted in the first assembling member 10, is electrically connected with the illuminating unit 30 and has three batteries 41.

Figure 7:
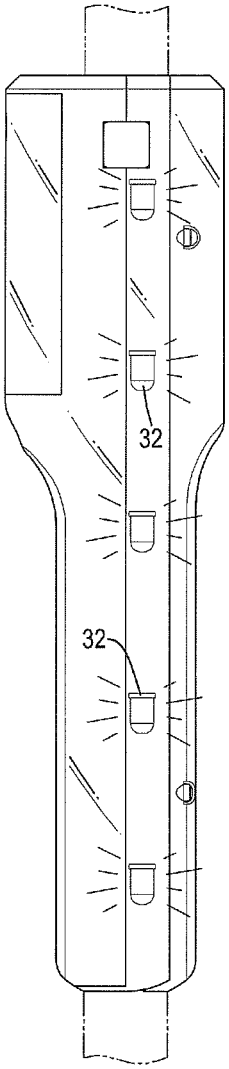
FIG. 7 is an operational side view of the warning lamp in FIG. 1.
Figure 8:
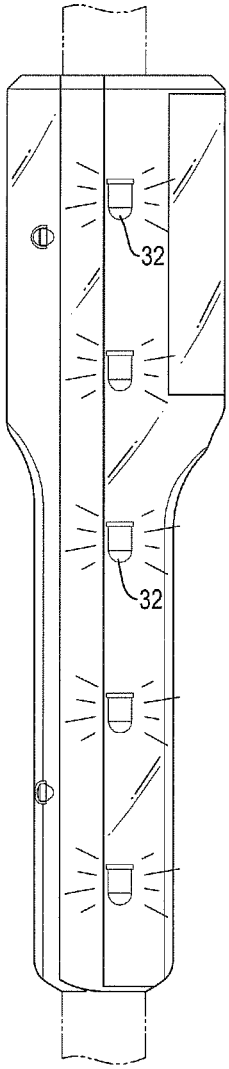
FIG. 8 is another operational side view of the warning lamp in FIG. 1.

With reference to FIGS. 7 and 8, the switch 33 is turned on and the LEDs 32 light up when the warning lamp is in use. Because the first assembling member 10 is pervious to light, light emitted from the LEDs 32 penetrates two opposite sides of the first assembling member 10. Accordingly, the warning lamp is capable of being illuminating.

The first assembling member 10 may be detachably and securely connected with the second assembling member 20 by inserting protrusions or hooks. The present invention does not limit the format of connection of the first assembling member 10 and the second assembling member 20.

The pressing section 21 and the clamping section 121 may have the same format. For example, the pressing section 21 is two tabs and the clamping section 121 is also two tabs. Or, the pressing section 21 is a channel and the clamping section 121 is also a channel. Or, the pressing section 21 is a channel and the clamping section 121 is two tabs such that the clamping spaces S is formed between the concave pressing section 21 and the concave clamping section 121 to encompass a bar B. The present invention does not limit the formats of the pressing section 21 and the clamping section 121.

The cross section of the clamping space S may be round, elliptic or in any other shape. The present invention does not limit the format of the cross section of the clamping space S.

Figure 10:
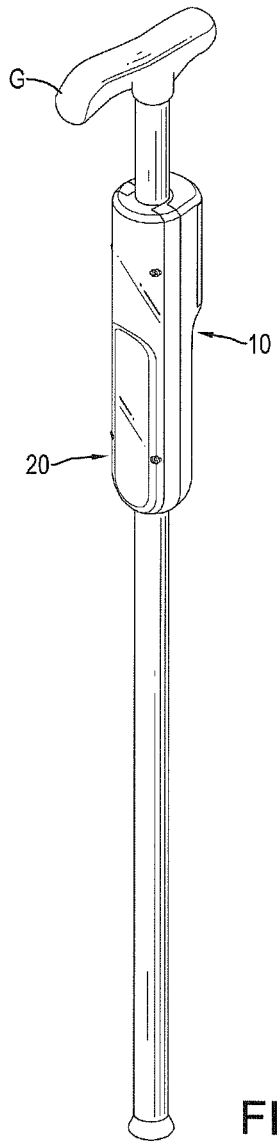
FIG. 10 is a perspective view of a walking stick in accordance with the present invention.
Figure 11:
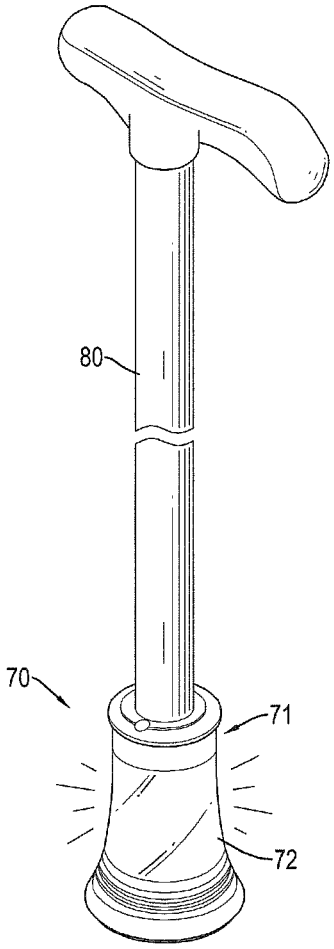
FIG.11 PRIOR ART
FIG. 11 is a conventional walking stick with a warning lamp in accordance with the prior art.

With reference to FIG. 10, a walking stick in accordance with the present invention has a stick body G and a warning lamp. The warning lamp clamps the stick body G. With the illuminating warning lamp, the walking stick can illuminate the surroundings and is very safe in use.

From the above description, it is noted that the present invention has the following advantage:

Because the second assembling member 20 is detachably and securely connected with the first assembling member 10, the warning lamp can clamp different objects, such as a walking stick, an umbrella or a measuring wheel, at different positions of the objects according to personal needs.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A warning lamp comprising:

a first assembling member being pervious to light and having:

an outer shell; and an inner sell securely connected with the outer shell and having a side; and a concave clamping section being an elongated channel, longitudinally formed through the side of the inner shell and being opposite to the outer shell;

a second assembling member detachably and securely connected with the shells of the first assembling member and having a concave pressing section facing the clamping section of the inner shell;

a clamping space formed between the pressing section of the second assembling member and the clamping section of the first assembling member and axially formed through the assembling members to enable a bar to extend out of the assembling members;

an illuminating unit securely mounted in the first assembling member between the shells and having at least one LED (light emitting diode); and a battery unit securely mounted in the first assembling member and electrically connected with the illuminating unit.

2. The warning lamp as claimed in claim 1, wherein the pressing section is two concave tabs protruding from a side of the second assembling member and respectively inserted into a top and a bottom of the clamping section of the inner shell.

3. The warning lamp as claimed in claim 1, wherein the clamping space has a round cross section.

4. The warning lamp as claimed in claim 2, wherein the clamping space has a round cross section.

5. The warning lamp as claimed in claim 1, wherein the first assembling member and the second assembling member are connected with each other by screws.

6. The warning lamp as claimed in claim 2, wherein the first assembling member and the second assembling member are connected with each other by screws.

7. A walking stick comprising:

a stick body; and a warning lamp securely mounted around the stick body, clamping the stick body and having:

a first assembling member being pervious to light and having:

an outer shell; and an inner shell securely connected with the outer shell and having a side; and a concave clamping section being an elongated channel, longitudinally formed through the side of the inner shell and being opposite to the outer shell;

a second assembling member detachably and securely connected with the shells of the first assembling member and having a concave pressing section facing the clamping section of the inner shell, wherein the pressing section and the clamping section clamp the stick body;

a clamping space formed between the pressing section of the second assembling member and the clamping section of the first assembling member and axially formed through the assembling members to enable the stick body to extend out of the assembling members;

an illuminating unit securely mounted in the first assembling member between the shells and having at least one LED (light emitting diode); and a battery unit securely mounted in the first assembling member and electrically connected with the illuminating unit.

8. The walking stick as claimed in claim 7, wherein the pressing section is two concave tabs protruding from a side of the second assembling member and respectively inserted into a top and a bottom of the clamping section of the inner shell.

9. The walking stick as claimed in claim 8, wherein the clamping space has a round cross section.

* * * * *